US006477811B1

(12) United States Patent
Choi

(10) Patent No.: US 6,477,811 B1
(45) Date of Patent: Nov. 12, 2002

(54) DAMP-PROOF BASEMENT AND METHOD OF CONSTRUCTION

(75) Inventor: Jung Woong Choi, 551-33, Banpo-dong, Seocho-gu, Seoul (KR), 13-040

(73) Assignee: Jung Woong Choi, Seoul (KR)

( * ) Notice: Subject to any disclaimer, the term of this patent is extended or adjusted under 35 U.S.C. 154(b) by 0 days.

(21) Appl. No.: 09/529,272

(22) PCT Filed: Aug. 11, 1999

(86) PCT No.: PCT/KR99/00444

§ 371 (c)(1),
(2), (4) Date: Jul. 14, 2000

(87) PCT Pub. No.: WO00/09828

PCT Pub. Date: Feb. 24, 2000

(30) Foreign Application Priority Data

Aug. 11, 1998 (KR) ..... 98-32598

(51) Int. Cl.[7] ..... E02D 19/00; E02D 27/00

(52) U.S. Cl. ..... 52/169.5; 52/169.11; 52/169.14; 52/293.1; 52/294

(58) Field of Search ..... 52/169.5, 169.14, 52/293.1, 294, 302.1, 302.3, 302.4, 310, 169.11

(56) References Cited

U.S. PATENT DOCUMENTS 3,561,175 A * 2/1971 Best ..... 52/169.11
5,056,281 A * 10/1991 McCarthy ..... 52/169.5
5,184,437 A * 2/1993 Woong et al. ..... 52/169.5
5,481,838 A * 1/1996 Fishel ..... 52/169.14
5,765,323 A * 6/1998 Belivacqua ..... 52/169.5
6,032,429 A * 3/2000 Choi ..... 52/612

* cited by examiner

*Primary Examiner*—Carl D. Friedman
*Assistant Examiner*—Kevin McDermott
(74) *Attorney, Agent, or Firm*—IP Strategies, P.C.

(57) ABSTRACT

A method of construction of a damp-proof basement includes disposing a water-permeable palette layer on a bottom surface of the interior of the basement and spaced from an outer wall of the basement, disposing a water-impermeable vent layer over the palette layer, disposing a reinforced-concrete slab on the vent layer and spaced from the outer wall, and disposing an inner wall at a periphery of the concrete slab and spaced from the outer wall. A damp-proof basement construction includes a water-permeable palette layer, disposed on a bottom surface of the interior of the basement, spaced from an outer wall of the basement. A water-impermeable vent layer is disposed over the palette layer. A reinforced-concrete slab is disposed on the vent layer, spaced from the outer wall. An inner wall is disposed at a periphery of the concrete slab, spaced from the outer wall.

15 Claims, 9 Drawing Sheets

DAMP-PROOF BASEMENT AND METHOD OF CONSTRUCTION

FIELD OF THE INVENTION

The invention is related to a structure for providing a damp-proof construction and method for removing factors that generate moisture or dampness in a basement room or subway (collectively referred to as basement herein), thereby keeping the space comfortable and free from moisture.

BACKGROUND OF THE INVENTION

A basement is generally an underground construction located in the earth as part of the foundation of a building or another substructure. Basements have problems that differ from those of buildings or facilities above the ground. First, water leakage frequently occurs in basements. As water flows underground, this underground water may penetrate the basement through the basement walls or base in contact with the ground.

Second, dew is likely to condense on walls of a basement. Because the interior of the basement is kept at a constant temperature, the basement is relatively warmer in winter and cooler in summer compared to the ground surrounding the basement. Thus, the space within the basement has a temperature that is higher than that of the walls or floor of the basement, thereby causing dew to form on the inner surfaces of the basement. This is called the dew condensation phenomenon.

Third, the humidity is relatively higher inside a basement. The air within a basement becomes very humid due to the water leakage and the dew condensation described above. The humidity in the air provides an environment that allows mold to grow easily. The humidity deteriorates articles or products stored in the basement, and makes it uncomfortable for people residing there.

Considering these points, when a basement is constructed conventionally, damp-proof construction is performed in various manners in order to prevent water leakage, but humidity in the basement air cannot be removed due to the dew condensation phenomenon. That is due to insufficient consideration of the dew condensation phenomenon in the basement. For such humidity to remain within the basement is inappropriate if a person resides there, or if articles or products are stored there. Thus, a basement is not usually utilized to its best capability.

In order to resolve these problems, the inventor of the present invention previously developed a damp-proof construction method for buildings, and obtained U.S. Pat. No. 5,184,437, which issued on Feb. 9, 1993. The '437 patent discloses a damp-proof construction for building basements and subway construction using a damp-proof brick and plastic palette as damp-proofing elements, in which damp-proof bricks formed of plastic materials are disposed on an underground base surface adjacent the inside surface of the outer wall of a building, and an inner wall is fabricated on the damp-proof brick layer with cement bricks, all on base surface of the underground basement. Plastic palettes are mounted to form a palette layer, a non-woven fabric covers the upper surface of the palette layer to form a non-woven fabric layer, and an upper mortar or reinforced-concrete slab is formed on the non-woven fabric layer. The '437 patent prevents the inflow of penetrating water from the underground base surface into the building construction, especially through the inner walls and the upper slab of the basement, such that the inner space of the basement remains in a comfortably humid state.

However, the '437 patent has a problem in that in order to provide sufficient stiffeners to the upper reinforced-concrete slab, careful construction is required. Otherwise, the upper reinforced-concrete slab will not have sufficient hardness. This is because the upper reinforced-concrete slab is mounted directly on the plastic palette layer through the non-woven layer, which may have water permeability. If the non-woven layer is formed of a water-permeable non-woven material and is layered, it acts as a vent layer having water permeability. As a result, the vent layer allows water required for the hydration action of the concrete to leak into the plastic palette layer, before the upper reinforced-concrete slab completely hardens under the hydration action. Thus, when the upper reinforced-concrete slab layer is applied, sufficient water should be supplied during the concrete hardening step to assure the stiffness of the reinforced-concrete slab is sufficient.

Also, the '437 patent lacks any countermeasure against the dew condensation phenomenon given that the upper reinforced-concrete slab and the inner wall are in contact with the outer walls through the non-woven fabric layer, the plastic palette, and the damp-proof bricks. Dew condenses on the surface of the upper reinforced-concrete slab due to the significant temperature difference between the inner walls and the upper slab, and the interior space of the basement.

SUMMARY OF THE INVENTION

The object of the invention is to provide a damp-proof basement construction for preventing water leakage from the ground surrounding the basement into the basement, for removing dew condensation, and for keeping constant room humidity within the basement.

The other object of the invention is to provide a damp-proof basement construction for improving the quality of an upper reinforced-concrete slab, and for establishing a better damp-proof effect in the basement.

According to the invention, a method of construction of a damp-proof basement includes disposing a water-permeable palette layer on a bottom surface of the interior of the basement and spaced from an outer wall of the basement, disposing a water-impermeable vent layer over the water-permeable palette layer, disposing a reinforced-concrete slab on the water-impermeable vent layer and spaced from the outer wall of the basement, and disposing an inner wall of the basement at a periphery of the reinforced-concrete slab and spaced from the outer wall of the basement.

A damp-proof basement construction includes a water-permeable palette layer, disposed on a bottom surface of the interior of a basement and spaced from an outer wall of the basement. A water-impermeable vent layer is disposed over the water-permeable palette layer. A reinforced-concrete slab is disposed on the water-impermeable vent layer and spaced from the outer wall of the basement. An inner wall of the basement is disposed at a periphery of the reinforced-concrete slab and spaced from the outer wall of the basement.

Such a damp-proof construction forms a buffering wall space between the inner and outer walls, separating them from each other. Therefore, even if the waterproofing work on the outer wall or the inner wall is not well done, and the underground water penetrates into the bottom slab of the outer wall, the penetrating water is effectively prevented from flowing into the inner space of the basement through the inner wall and the reinforced-concrete slab due to separation from the outer wall or the bottom slab by the buffering wall space and the water-permeable palette layer.

Also, the air in the basement room does not directly contact the outer wall or the bottom slab, but rather contacts the inner wall or the upper reinforced-concrete slab, thereby effectively preventing the dew condensation phenomenon from occurring thereon. Therefore, it is noted that the invention is different than the '437 patent in the respect that it prevents water penetration and the dew condensation phenomenon within the inner space of the basement.

BRIEF DESCRIPTION OF THE DRAWINGS

The invention now will be described in detail with reference to the accompanying drawings, in which.

DETAILED DESCRIPTION OF THE INVENTION

Figure 1:
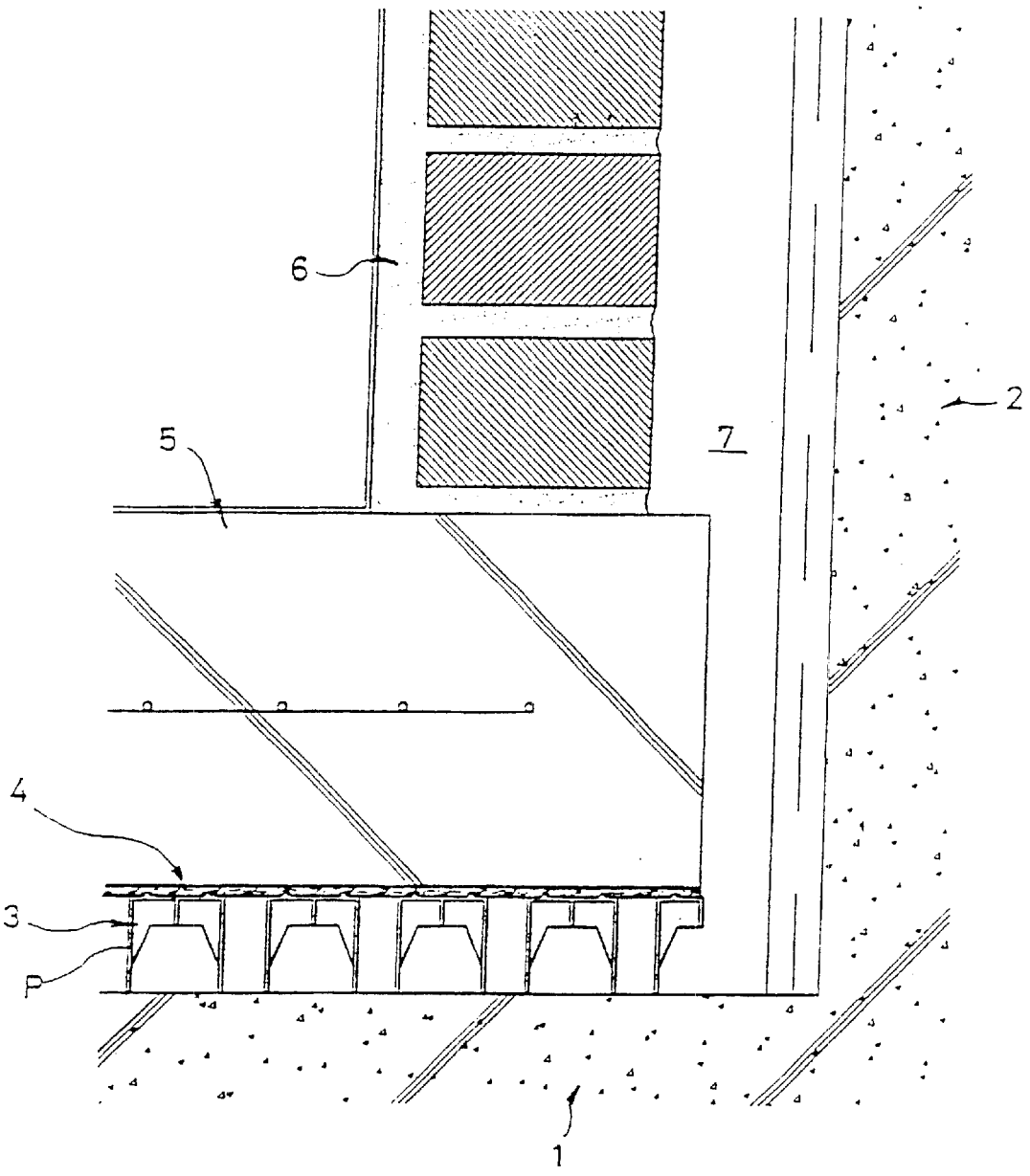
FIG. 1 is a cross-sectional view illustrating the basic technical configuration of a basement damp-proof construction according to the invention.
Figure 2:
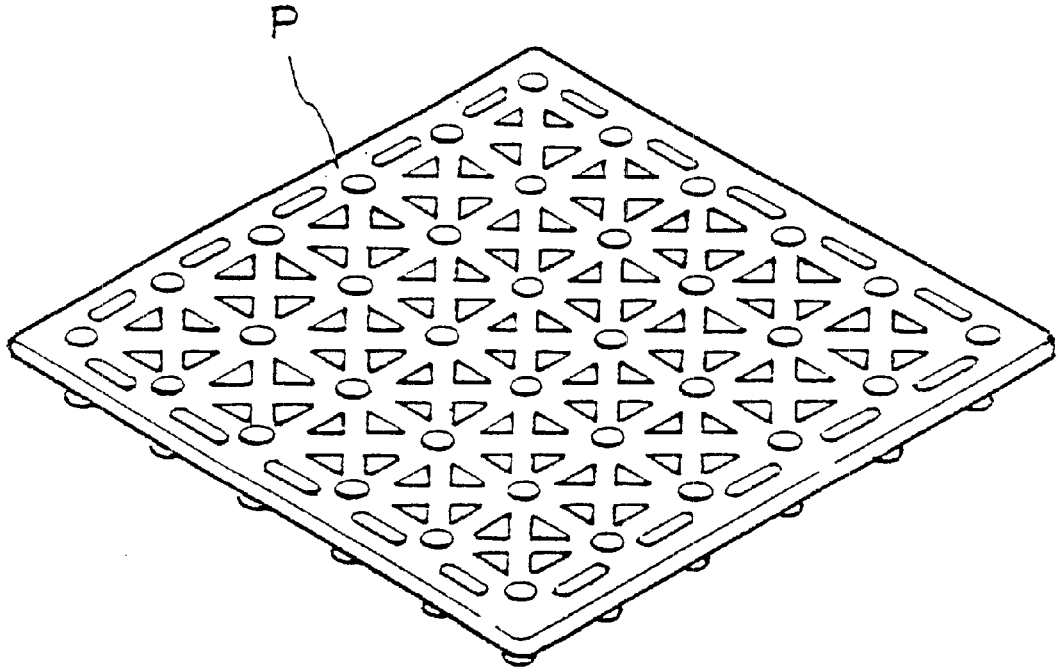
FIG. 2 is a perspective view illustrating a water-permeable palette utilized as part of a water-permeable palette layer according to the invention.

Referring to FIGS. 1 and 2, illustrating a first embodiment of the invention, a basement of a building includes a bottom slab 1 and an outer wall 2, which are generally formed of reinforced concrete. Water-permeable palettes P are disposed on the bottom slab 1 and are connected to each other so as to form a water-permeable palette layer 3, in which the water-permeable palette P is made of a synthetic resin or plastic material and has a configuration that allows water and air to pass through its upper, lower, left, and right portions. The water-permeable palette layer 3 is spaced at a predetermined interval from the outer walls 2 of the basement. A water-impermeable vent layer 4, including waterproof cloths or canvas, is layered on the water-permeable palette layer 3, such that the waterproof cloth allows air to pass through, but prevents water penetration. An upper reinforced-concrete slab 5 is formed on the water-impermeable vent layer 4, disposed such that it is spaced from the outer walls 2. The water-penetrating palette P as used herein is described in detail, referring to FIG. 5 of the '437 patent, further explanation of which is omitted. The configuration illustrates the basic technical concept of the invention.

Figure 3:
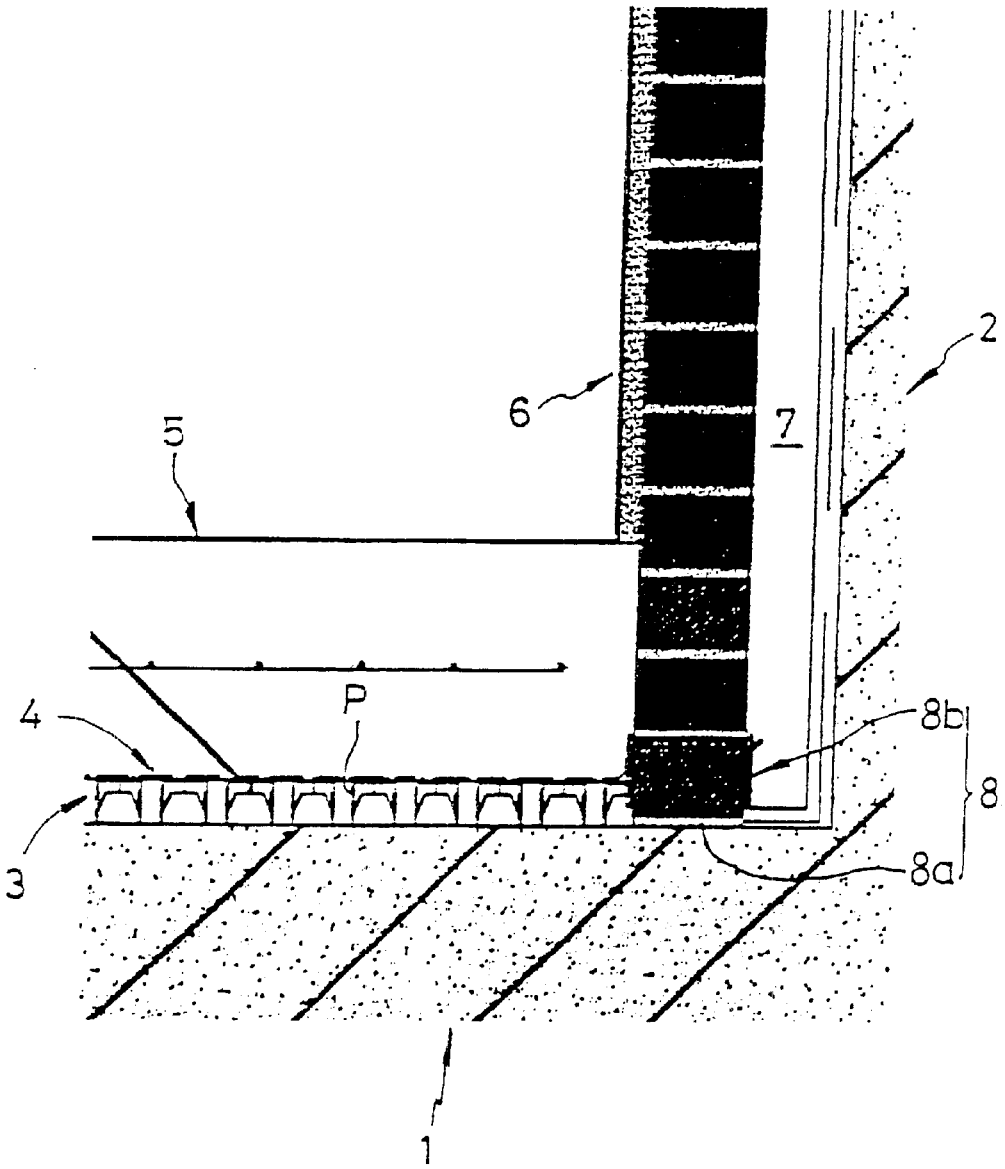
FIG. 3 is a cross-sectional view illustrating the technical configuration of damp-proof bricks mounted on the peripheral ends of the water-permeable palette layer, and an inner wall fabricated thereon according to the invention.
Figure 4:
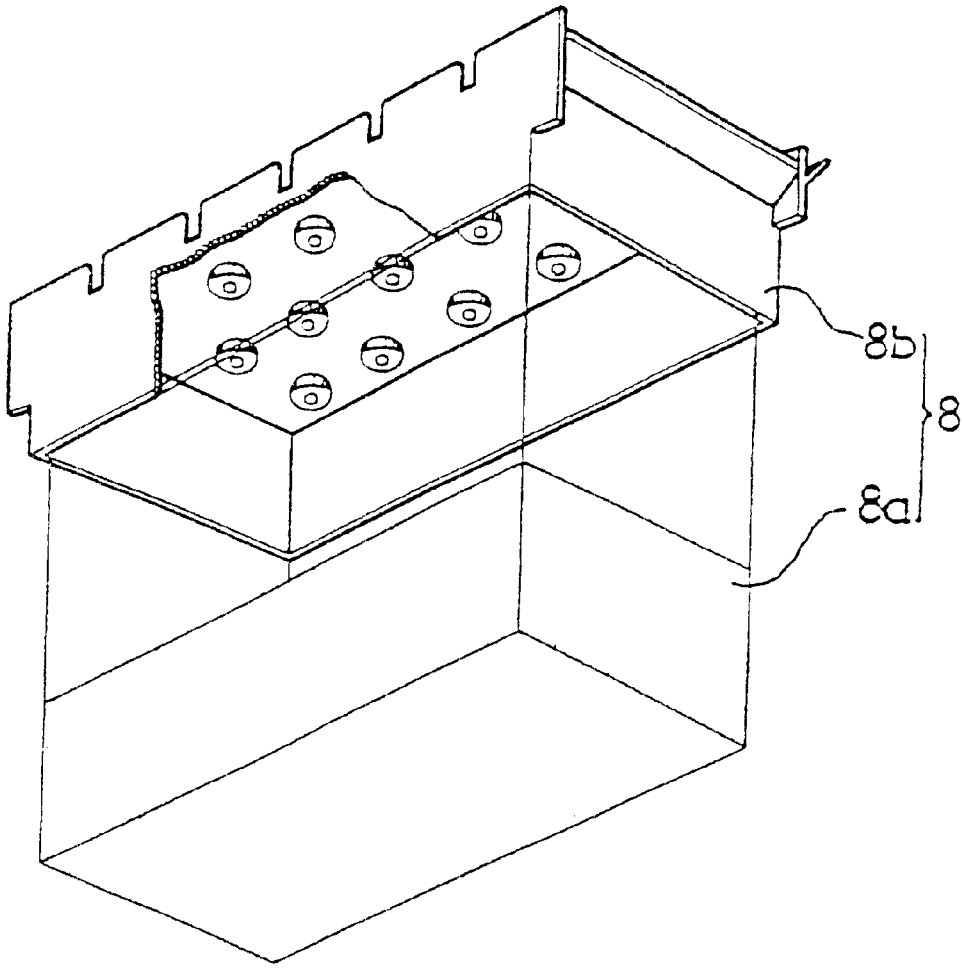
FIG. 4 is a perspective view illustrating a damp-proof brick according to the invention.

Referring to FIGS. 3 and 4, illustrating a second embodiment of the invention, damp-proof bricks 8 are positioned along the peripheral edges of a water-permeable palette layer 3, which include a plurality of water-permeable palettes P connected to one another. Next, inner walls 6 are fabricated of normal bricks 8*a* on the damp-proof bricks 8. The damp-proof brick 8 includes a normal brick 8*a* and a cover structure 8*b* made of synthetic resins, and is sealed at its upper surface, as shown in FIG. 4. An upper reinforced-concrete slab 5 is formed over the water-permeable palette layer 3 on a water impermeability vent layer 4. Therefore, the second embodiment has an advantage in that placement of the upper reinforced-concrete slab 5 such that it is spaced at a predetermined interval from the outer wall 2 is facilitated by previously setting the peripheral edges of the water-permeable palette layer 3 on the bottom surface of the basement.

Herein, it is noted that the water-impermeable vent layer 4 allows air to freely pass therethrough, but prevents water from penetrating thereinto. Thus, the water-impermeable vent layer 4 plays a decisively important role in maintaining the good quality of the upper reinforced-concrete slab 5 and preventing the occurrence of the dew condensation phenomenon.

First, it is known that reinforced concrete is hardened by the hydration action of cement with water. Therefore, water leakage from the cement should be prevented before the cement is sufficiently hydrated with water during the hardening process of the reinforced concrete. The water-impermeable vent layer 4 prevents water leakage from the not-yethardened cement used to form the upper reinforced-concrete slab 5.

Second, it often happens that penetrating water exists on the bottom slab 1 despite the waterproofing process. Also, sealed air fills in the spaces of the water-permeable palette layer 3. The reinforced-concrete slab 5 construction has fine porous holes throughout its entire body, through which a large amount of air is communicated.

Therefore, the water-impermeable vent layer 4, mounted on the water-permeable palette layer 3, allows the air filling the space of the water-permeable palette layer 3 to pass freely through the upper reinforced-concrete slab 5. It prevents air filled in the space of the water-permeable palette layer 3 from becoming too humid so that the space of the water-permeable palette layer 3 functions to have its own inherent thermal insulation performance. In other words, the water-impermeable vent layer 4 prevents the deterioration of the thermal insulation performance that the water-permeable palette layer 3 space provides. Furthermore, the water-impermeable vent layer 4 effectively prevents the occurrence of the dew condensation phenomenon on the upper reinforced-concrete slab 5.

As described herein, there are various woven or non-woven fabrics that can be used as the waterproof cloths or canvas forming the water-impermeable vent layer 4. It is noted that the woven fabrics or non-woven fabrics that can be used allow air to be passed therethrough, but prevent water from being passed therethrough.

On the other hand, there may be columns, partition walls, trenches, etc. mounted in a basement. These structures may direct the moving path of cooling air and penetrated water or collected water that accidentally generates to cause problems in the basement. Therefore, it is necessary to apply a finishing process to these structures.

Figure 5:
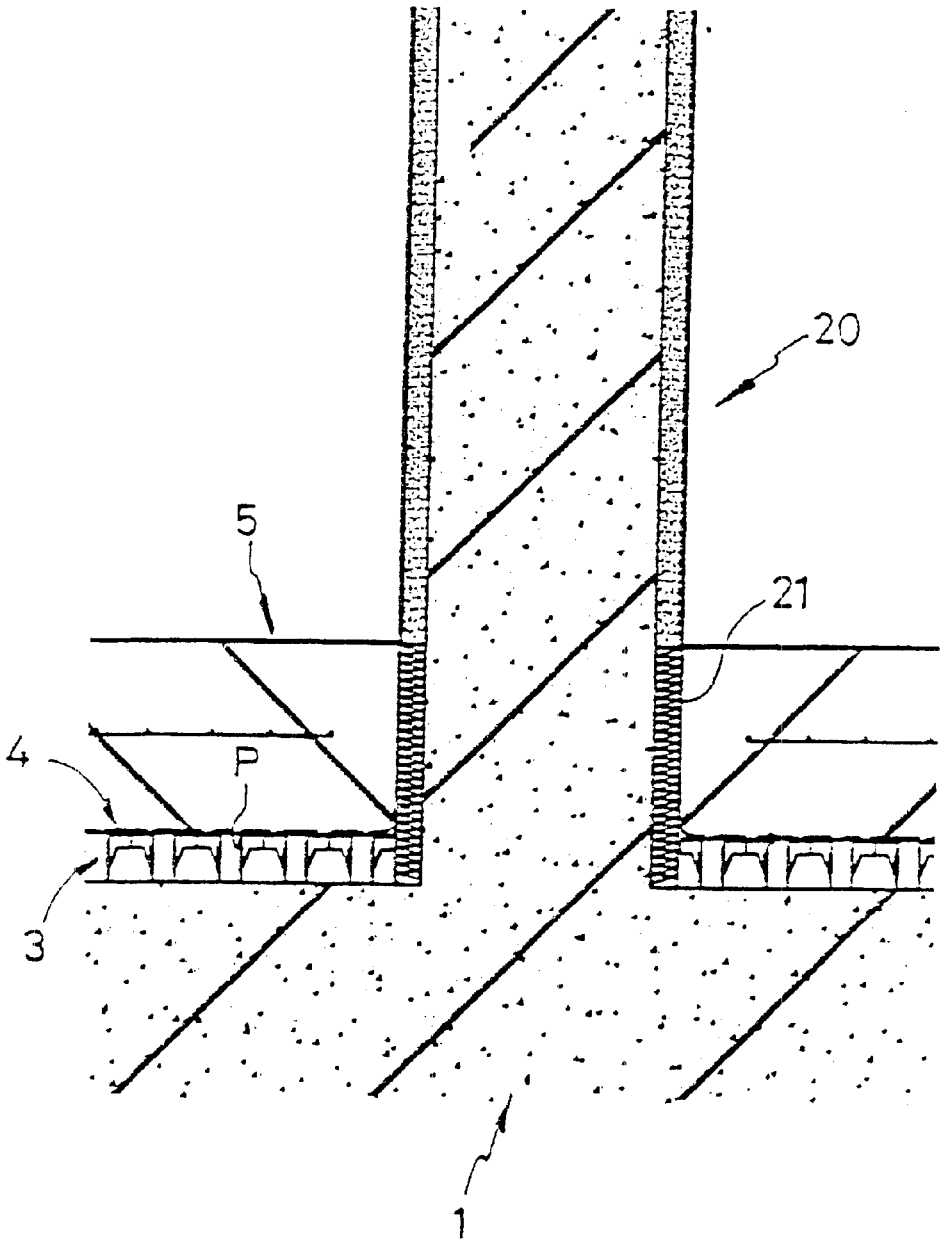
FIG. 5 is a cross-sectional view illustrating an embodiment of the technical configuration for finishing the surroundings of a column according to the invention.

Referring to FIG. 5, column 20 extends from a bottom slab 1 to a top slab (not shown) of a basement, passing through a water-permeable palette layer 3 and an upper reinforced-concrete slab 5. Around the lower periphery of the column 20, a thermal insulation material 21 is preferably wrapped so that cooling of the bottom slab 1 is interrupted and not transferred to the upper reinforced-concrete slab 5. This technical configuration helps prevent the dew condensation phenomenon that could occur where the upper reinforced-concrete slab 5 contacts the column 20.

Figure 6:
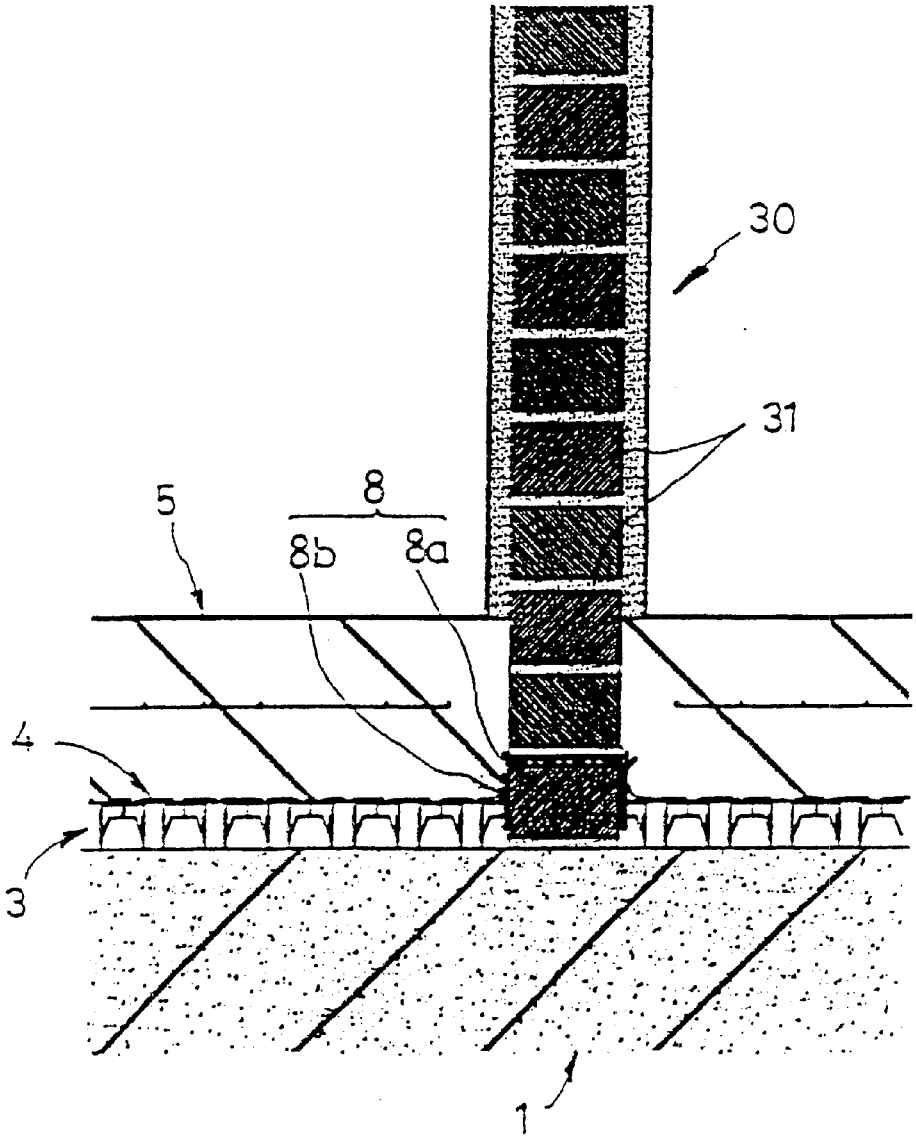
FIG. 6 is a cross-sectional view illustrating an embodiment of the technical configuration for finishing the surroundings of a partition wall, which is mounted in a basement according to the invention.

Referring to FIG. 6, a partition wall 30 extends from a bottom slab 1 to a top slab of a basement. In this case, damp-proof bricks 8 are positioned along the passage previously made to construct the partition wall 30, and then normal bricks 31 are stacked on the damp-proof bricks 8. As shown, the damp-proof bricks 8 prevent the dew condensation phenomenon that could occur where the upper reinforced-concrete slab 5 contacts the partition wall 30.

Figure 7A:
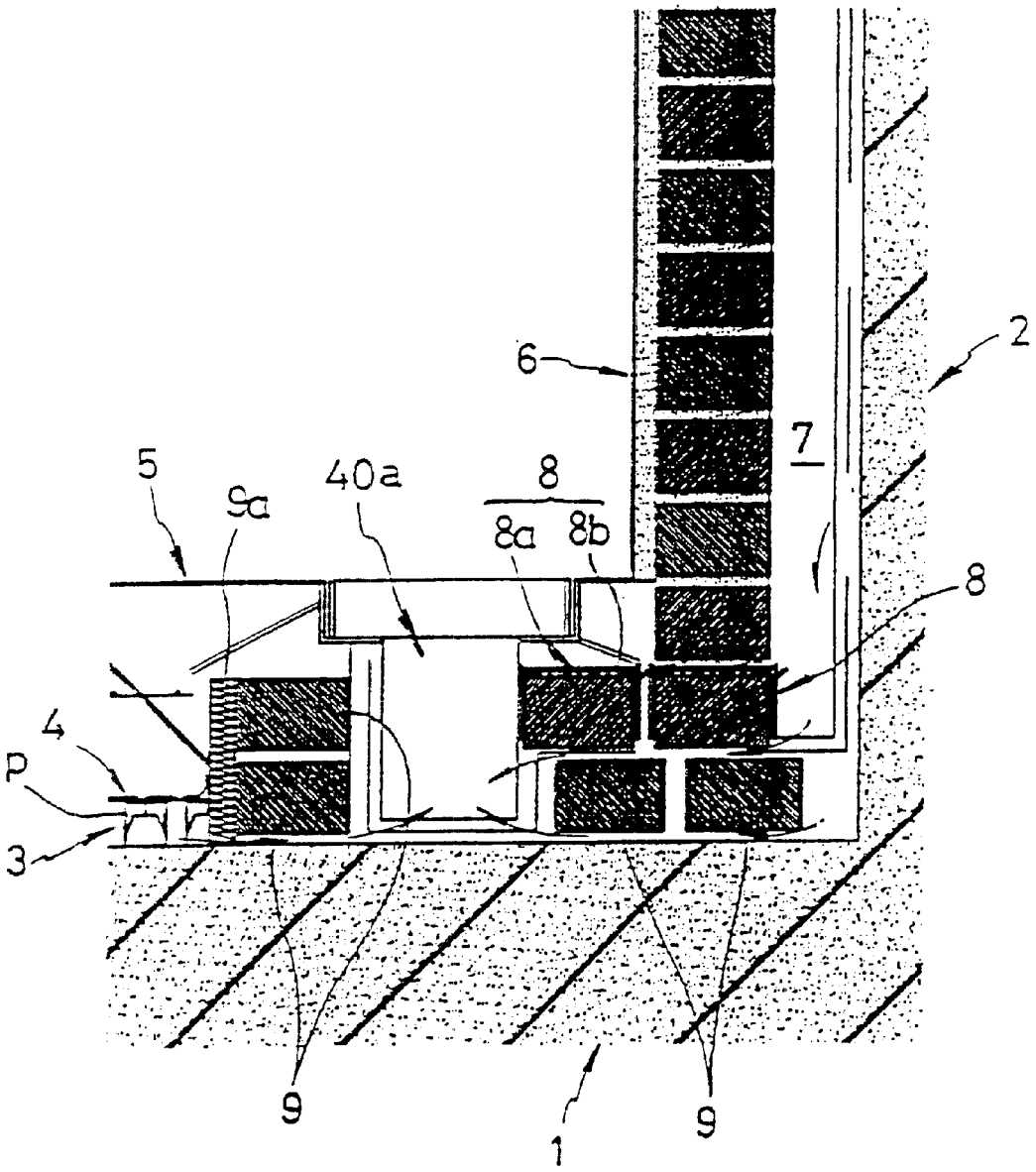
FIGS. 7*a* through 7*c* are cross-sectional views illustrating embodiments of the technical configuration for finishing the surroundings of water discharging trenches, which are respectively mounted in different configurations in a basement according to the invention.
Figure 7B:
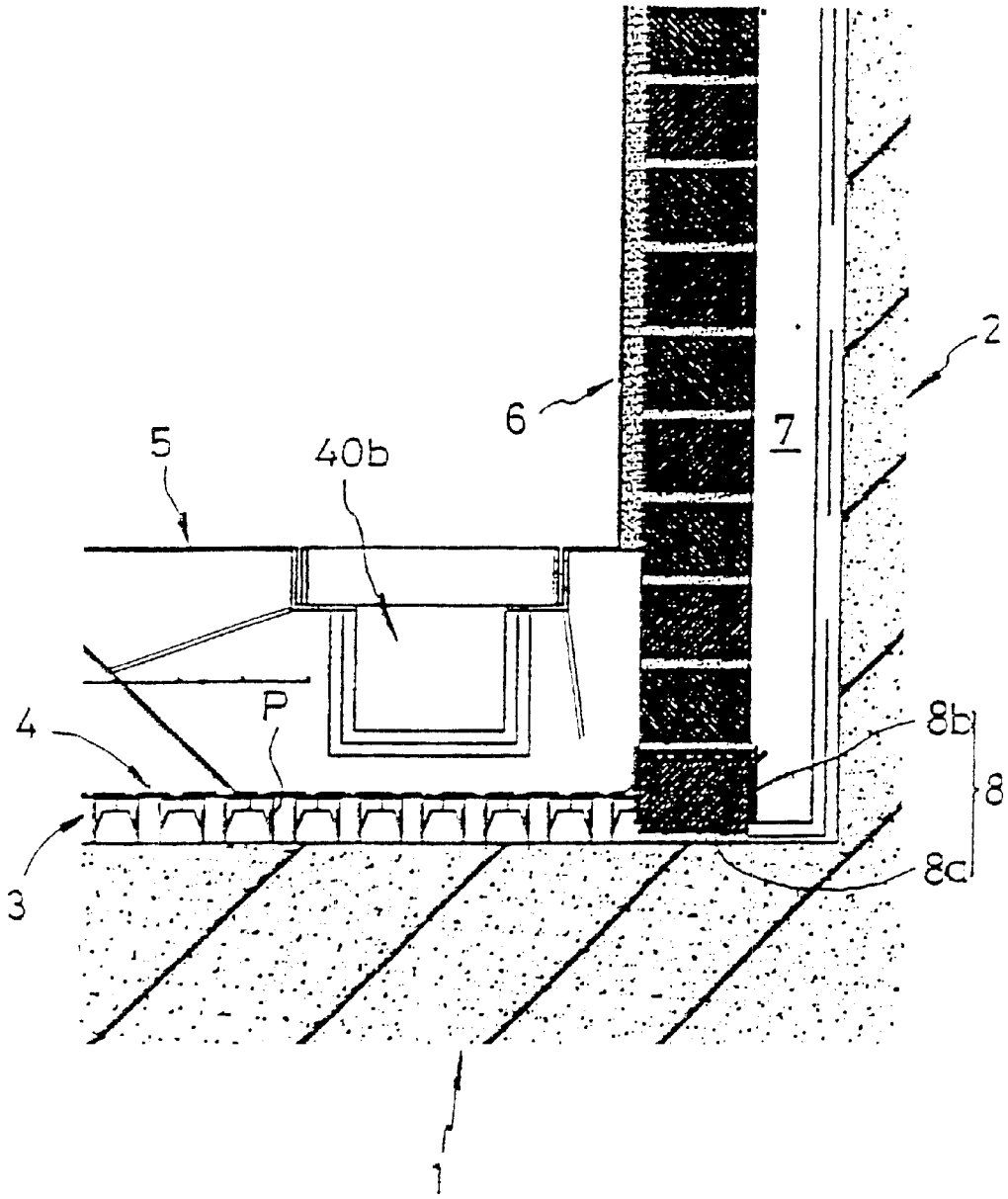
Figure 7C:
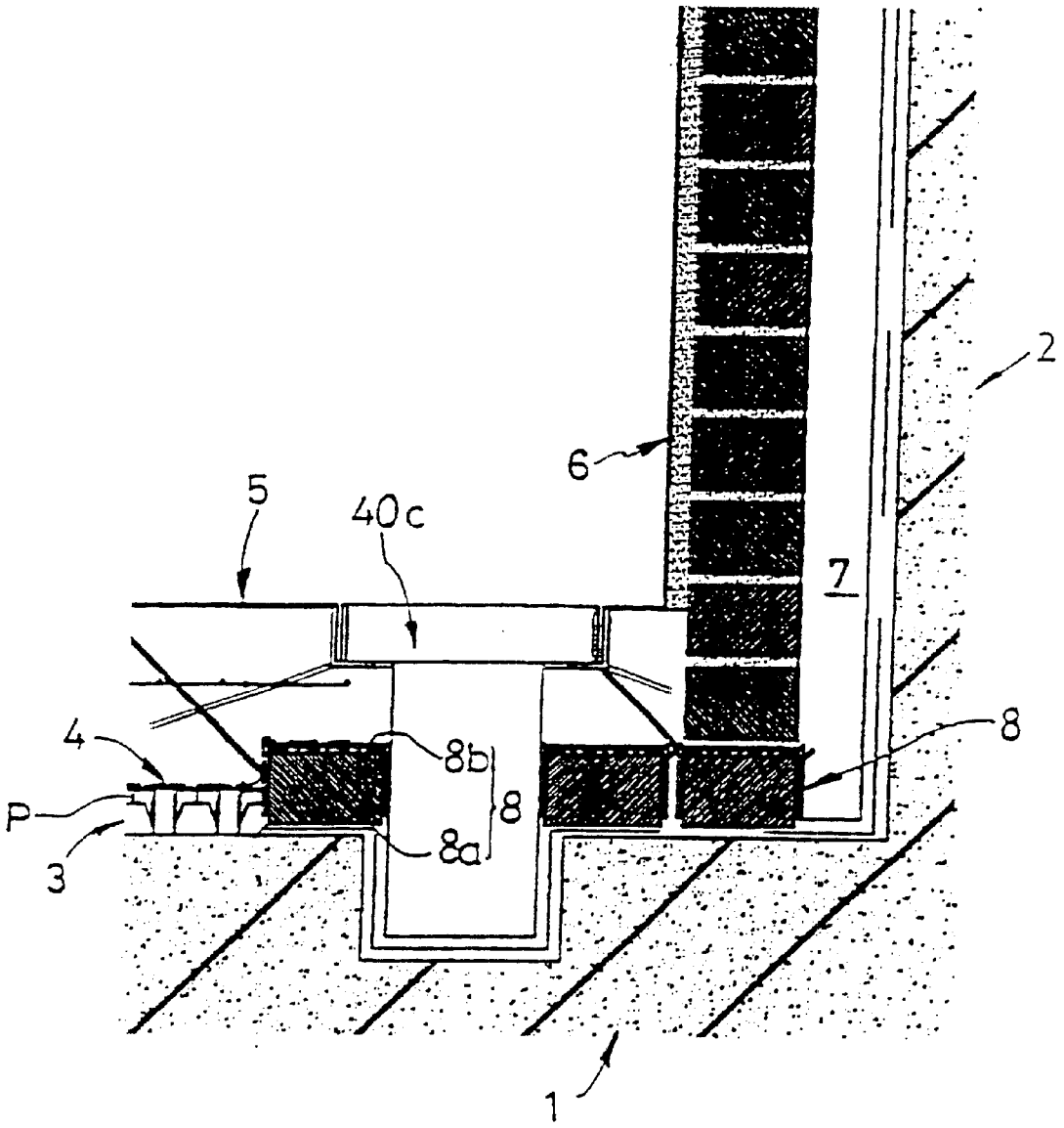

Referring to FIGS. 7*a* through 7*c,* water discharging trenches 40*a,* 40*b,* and 40*c* are formed in a basement. As shown in FIG. 7*a,* the water discharging trench 40*a* is formed adjacent a bottom slab 1 at its bottom surface and an inner wall 6 at the surface of one side. In this case, a waterproofing process is not applied to mortar or reinforced concrete poured and trench bricks 9 stacked around the lower periphery of the trench 40*a*. The purpose of the trench 40*a* is to discharge water penetrating into a buffering wall space 7 from the waterproof layer of an outer wall 2 into a water-permeable palette layer 3, from the bottom slab 1 through the water discharging trench 40*a,* so as to remove moisture from an upper reinforced-concrete slab 5.

As shown in the drawings, if the inner wall 6 is positioned adjacent the periphery of the trench 40*a,* penetrating water is diffused by capillary action throughout the upper reinforced-concrete slab 5 and the inner wall 6 through the trench bricks 9 and the reinforced concrete to which the waterproof process is not applied. Therefore, it is desirable that adjacent the upper side surface of the trench 40*a* adjacent the inner wall 6, another damp-proof brick 8 is positioned on the trench bricks 9, aligned with the damp-proof brick 8 of the inner wall 6. This damp-proof brick 8 prevents the moisture from the penetrating water from traveling by capillary action into the upper reinforced-concrete slab 5 and the inner wall 6. Also, the trench bricks 9 are positioned to separate the water-permeable palette layer 3 from 20 the trench 40*a,* and around the outer periphery of which thermal insulation material layer 9*a* is wrapped. The thermal insulation material layer 9*a* prevents the cool outside temperature from transferring through the trench 40*a* into the inner space of the basement.

Referring to FIG. 7*b,* a water-permeable palette layer 3 is arranged on a bottom slab 1. An upper reinforced-concrete slab 5 is layered on the water-permeable palette layer 3 through a water-impermeable vent layer 4. A trench 40*b* is formed in the upper reinforced-concrete slab 5. In this case, the waterproofing treatment is applied to the inner portions of the trench 40*b,* such as inner wall surfaces and the bottom surface, so as to prevent the penetration of water into the upper reinforced-concrete slab 5. The technical configuration is most suitable for a place where the reinforced-concrete slab 5 is thick enough to secure the depth of the trench 40*b,* or an amount of discharge water is relatively small.

Referring to FIG. 7*c,* a trench 40*c* is formed passing though an upper reinforced-concrete slab 5 and partly penetrating a bottom slab 1. In this case, the waterproofing treatment is applied to the inner surfaces of the trench 40*c,* such as inner walls and the bottom. Also, around the periphery of the trench 40*c,* damp-proof bricks 8 are arranged adjacent a water-permeable palette layer 3, aligned with the lowest damp-proof brick 8 of an inner wall 6. Therefore, the technical configuration prevents the penetration of water from the bottom slab 1, the upper reinforced-concrete slab 5, and the inner wall 6 into the trench 4*c*.

As described above, a water-impermeable vent layer 4 is disposed on the lower portion of an upper reinforced-concrete slab 5 to maintain the good quality of the upper reinforced-concrete slab 5 and to prevent the occurrence of the dew condensation phenomenon on the upper reinforced-concrete slab 5, thereby providing the damp-proof effect in the basement.

What is claimed is:

1. A damp-proof basement construction, comprising:

a water-permeable palette layer, disposed on a bottom surface of the interior of a basement and spaced from an outer wall of the basement;

a water-impermeable vent layer disposed over the water-permeable palette layer;

a reinforced-concrete slab disposed on the water-impermeable vent layer and spaced from the outer wall of the basement;

an inner wall of the basement, disposed at a periphery of the reinforced-concrete slab and spaced from the outer wall of the basement;

a trench disposed to pass through the water-permeable palette layer, the water-impermeable vent layer, and the reinforced-concrete slab; and at least one trench brick disposed over the bottom surface of the interior of the basement, adjacent the trench.

2. The damp-proof basement construction of claim 1, wherein the inner wall of the basement is disposed on the reinforced-concrete slab.

3. The damp-proof basement construction of claim 1, wherein one of said at least one trench brick is disposed between the trench and the inner wall of the basement.

4. The damp-proof basement construction of claim 3, further including a damp-proof brick, disposed over the one of said at least one trench brick.

5. The damp-proof basement construction of claim 1, wherein one of said at least one trench brick is disposed such that the trench is positioned between the one of said at least one trench brick and the inner wall of the basement.

6. The damp-proof basement construction of claim 5, further comprising thermal insulation material, disposed so as to separate one of said at least one trench brick from the water-permeable palette layer, the water-impermeable vent layer, and the reinforced-concrete slab.

7. The damp-proof basement construction of claim 1, wherein the inner wall of the basement includes a first normal brick, disposed on the bottom surface of the interior of the basement and spaced from the outer wall of the basement;

a damp-proof brick, disposed over the normal brick; and at least a second normal brick, disposed over the damp-proof brick.

8. A damp-proof basement construction, comprising:

a water-permeable palette layer, disposed on a bottom surface of the interior of a basement and spaced from an outer wall of the basement;

a water-impermeable vent layer disposed over the water-permeable palette layer;

a reinforced-concrete slab disposed on the water-impermeable vent layer and spaced from the outer wall of the basement;

an inner wall of the basement, disposed at a periphery of the reinforced-concrete slab and spaced from the outer wall of the basement; and a trench disposed in the reinforced-concrete slab.

9. The damp-proof basement construction of claim 8, wherein the trench includes a waterproof treatment on interior surfaces of the trench.

10. The damp-proof basement construction of claim 8, wherein the inner wall of the basement includes a damp-proof brick, disposed on the bottom surface of the interior of the basement and spaced from the outer wall of the basement; and at least one normal brick, disposed over the damp-proof brick.

11. The damp-proof basement construction of claim 8, wherein the inner wall of the basement is disposed on the reinforced-concrete slab.

12. A damp-proof basement construction, comprising:

a water-permeable palette layer, disposed on a bottom surface of the interior of a basement and spaced from an outer wall of the basement;

a water-impermeable vent layer disposed over the water-permeable palette layer;

a reinforced-concrete slab disposed on the water-impermeable vent layer and spaced from the outer wall of the basement;

an inner wall of the basement, disposed at a periphery of the reinforced-concrete slab and spaced from the outer wall of the basement;

a trench disposed to pass through the water-permeable palette layer, the water-impermeable vent layer, and the reinforced-concrete slab, and passing through the bottom surface of the interior of the basement into a bottom slab of the basement; and at least one damp-proof brick disposed over the bottom surface of the interior of the basement, adjacent the trench;

wherein the trench includes a waterproof treatment on interior surfaces of the trench.

13. The damp-proof basement construction of claim 12, wherein the at least one damp-proof brick is a plurality of damp-proof bricks around the periphery of the trench.

14. The damp-proof basement construction of claim 12, wherein the inner wall of the basement includes a damp-proof brick, disposed on the bottom surface of the interior of the basement and spaced from the outer wall of the basement; and at least one normal brick, disposed over the damp-proof brick.

15. The damp-proof basement construction of claim 12, wherein the inner wall of the basement is disposed on the reinforced-concrete slab.

* * * * *